United States Patent [19]

Fortmann

[11] 4,281,918

[45] Aug. 4, 1981

[54] ELECTROPHOTOGRAPHIC COPIER PERMITTING A TONER DISPENSING CASSETTE TO BE SUBSEQUENTLY EMPLOYED AS A RESIDUAL TONER RECEPTACLE

[75] Inventor: Hermann Fortmann, Bremen, Fed. Rep. of Germany

[73] Assignee: Olympia Werke AG, Wilhelmshaven, Fed. Rep. of Germany

[21] Appl. No.: 64,525

[22] Filed: Aug. 6, 1979

[30] Foreign Application Priority Data

Aug. 7, 1978 [DE] Fed. Rep. of Germany ..... 2834508

[51] Int. Cl.[3] ..... G03G 15/00

[52] U.S. Cl. ..... 355/3 R; 222/DIG. 1; 222/171; 355/3 DD; 355/15

[58] Field of Search ..... 355/3 DD, 3 R, 15; 222/DIG. 1, 167, 171, 519, 548

[56] References Cited

U.S. PATENT DOCUMENTS

| | | | |
|---|---|---|---|
| 3,339,807 | 9/1967 | Eichorn | 222/171 |
| 3,374,768 | 3/1968 | Lawes et al. | 222/DIG. 1 |
| 3,552,850 | 1/1971 | Royka et al. | 355/15 |
| 3,752,576 | 8/1973 | Gerbasi | 355/3 DD |
| 4,062,385 | 12/1977 | Katusha et al. | 222/DIG. 1 |
| 4,089,601 | 5/1978 | Navone | 222/DIG. 1 |

*Primary Examiner*—R. L. Moses
*Attorney, Agent, or Firm*—Spencer & Kaye

[57] ABSTRACT

In a photocopier including a movable member carrying a photoconductive layer, a charging station for charging the layer, an illuminating station for photographically exposing the layer, a developing station provided with a magnetic brush and arranged to supply a magnetic single component toner to the brush for developing the image formed on the layer, a transfer station for transferring the developed image to a record material sheet, and a cleaning station for cleaning the layer, the stations being disposed in succession along the path of movement of the movable member for bringing each portion of the layer into operative association with each station in succession, in combination with a cassette containing a supply of such toner, the developing station is provided with a structure for receiving and holding the cassette in a position for dispensing toner for supply thereof to the magnetic brush, and the cleaning station is provided with a structure for receiving and holding the cassette in a position for collecting residual toner removed from the photoconductive layer in the cleaning station, whereby one and the same cassette can be used to initially supply toner to the developing station and, after having been substantially emptied, can serve as a receptacle for residual toner in the cleaning station.

6 Claims, 2 Drawing Figures

ELECTROPHOTOGRAPHIC COPIER PERMITTING A TONER DISPENSING CASSETTE TO BE SUBSEQUENTLY EMPLOYED AS A RESIDUAL TONER RECEPTACLE

BACKGROUND OF THE INVENTION

The present invention relates to an electrophotographic copier of the type having a movable member carrying a photoconductive layer, a charging station for charging the layer, an illuminating station for photographically exposing the layer, a developing station provided with a magnetic brush and arranged to supply a magnetic single component toner to the brush for developing the image formed on the layer, a transfer station for transferring the developed image to a record material sheet, and a cleaning station for cleaning the layer, the stations being disposed in succession along the path of movement of the movable member for bringing each portion of the layer into operative association with each station in succession, in combination with a cassette containing a supply of such toner.

Electrophotographic copiers, referred to hereinafter as photocopiers, customarily use a powdered toner to develop a latent electrostatic image created on a photoconductive layer on a belt or drum. Powder particles are dusted or brushed over the latent image and these particles are selectively attracted by electrostatically charged zones on the photoconductive layer to form a visible pattern, or image, of powder particles corresponding to the latent image. Since toner powder is consumed in the process, it is necessary to periodically replenish the photocopier with new toner. However, the conventional, commercially available toner powders are extremely difficult to handle. These toners blacken everything with which they come into contact. Moreover, it is difficult to completely empty a toner container.

Disposable commercially available toner containers are generally opened by the user who then empties their contents into a toner discharge device in the photocopier. Manual emptying of the toner container into the toner discharge device without blackening oneself or one's clothing can be performed only with difficulty and is often impossible. If the user uses a toner cassette or cartridge, he is left with a lid or sealing element which has already been soiled with toner. Additionally, it often happens very easily that part of the toner powder from this cover or sealing element inadvertently comes into contact with, and soils, the user's hands or clothing.

German Offenlegungsschrift No. 2,705,646 discloses a photocopier in which the toner is supplied in a closed cassette to a reservoir container in the developing apparatus. This cassette is disposable and is designed so that it cannot be reused once its content of developing powder has been used up. Reuse of the cassette after emptying is impossible. Moreover, in copiers employing a single component toner as the developing powder, the residual toner removed from the photoconductive layer by the cleaning apparatus cannot be returned to the reservoir container of the developing device.

SUMMARY OF THE INVENTION

It is therefore an object of the present invention to provide a photocopier in which clean and simple replenishment of developer powder is possible and in which the residual toner which has been removed from the photoconductive layer by the cleaning apparatus can be returned to the reservoir container in the developing apparatus.

These and other objects are achieved, according to the invention, in a photocopier of the type described above, by providing the developing station with means for receiving and holding the cassette in a position for dispensing toner for supply thereof to the magnetic brush, providing the cleaning station with means for receiving and holding the same cassette in a position for collecting residual toner removed from the photoconductive layer in the cleaning station, whereby one and the same cassette can be used to initially supply toner to the developing station and, after having been substantially emptied, can serve as a receptacle for residual toner in the cleaning station.

It is thus possible to subsequently use a cassette, which can be attached to the developing apparatus, as a collecting vessel for the cleaning apparatus. Preferably, the cassette is constructed so that it can be inserted into and removed from both the developing station and the cleaning station only when it is in its closed state, thereby assuring that the operator's hands cannot come into contact with the toner. This also assures that the operator cannot refill the cassette, when it is empty, with developer powder of a different brand.

DESCRIPTION OF THE PREFERRED EMBODIMENTS

Figure 1:
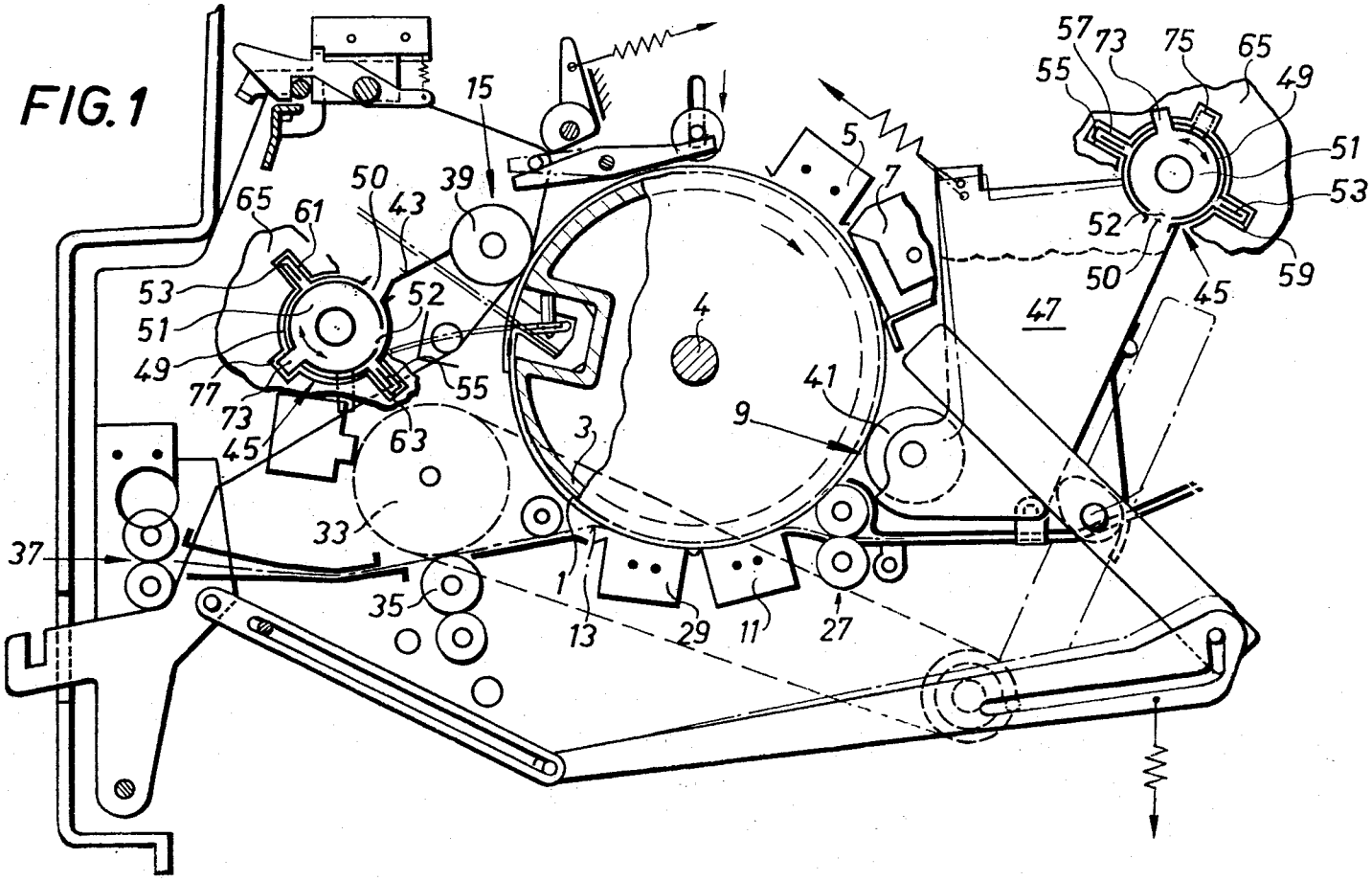
FIG. 1 is a cross-sectional, elevational view of a copier according to the invention, showing the parts which are essential to the present invention.

In FIG. 1 the parts of a photocopier relevant to the present invention are shown schematically in section. A photoconductive sheet 1 is firmly connected to a guide drum 3. The guide drum 3 is mounted to be rotatable in the frame of the machine (not shown) and points on its circumference can travel in this way past the individual process stations. The photoconductive sheet 1 is first charged in a charging station 5, then photographically exposed in an exposure station 7 and developed in a developing station 9. In a transfer station 11, the image present on the photoconductive sheet 1 is then transferred onto a record material sheet 13. Toner particles still remaining on the photoconductive sheet 1 after the transfer are then removed from the photoconductive sheet 1 in a cleaning station 15. The above-mentioned process stations are shown only schematically and may of course also be of different design.

The record material coming from a supply roll (not shown) is transported by pairs of transporting rollers to a cutting device where individual sheets are cut off to correspond to the original being copied. The cut sheets are then brought, by a further pair of transport rollers 27, into contact with the photoconductive sheet 1 on the guide drum 3. In the transfer station 11 the image developed on the photoconductive sheet 1 is transferred to the record sheet 13. After this image transfer, the record sheet 13 is separated again from the photoconductive sheet 1 by a separating sheet 29 and brought to a pressure fixing station 31. This pressure fixing station 31 includes two mutually resilient, spring-biased, pressure rollers 33 and 35. After pressure fixing of the toner image on the record sheet 13, the latter is brought to a discharge depository by means of a pair of transport rollers 37.

A cleaning station 15 is provided with a magnetic brush 39 made of the same magnetic single component toner as the magnetic brush 41 of the developing station 9. This brush 39 cleans the photoconductive sheet 1 after the toner image has been transferred from the photoconductive sheet 1. After the transfer process, this magnetic cleaning brush 39 removes the remaining toner particles from the photoconductive sheet 1. A stripper 43 which cooperates with the magnetic cleaning brush 39 causes the toner particles to be brought into a cassette 45 which serves as the collecting vessel. An identical cassette 45 containing fresh powdered single-component toner can also be attached to a reservoir container 47 in the developing station 9.

Figure 2:
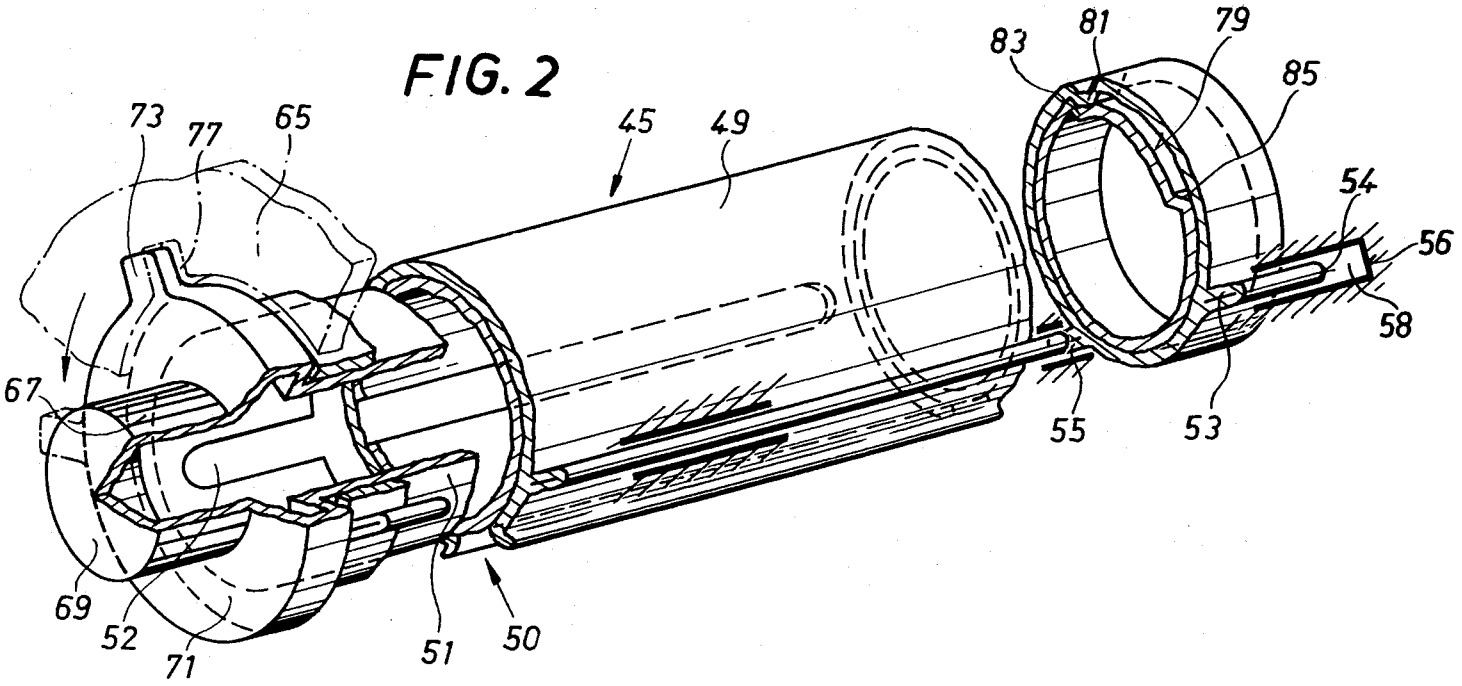
FIG. 2 is a perspective view of a preferred embodiment of a cassette according to the invention.

Referring to FIGS. 1 and 2, cassette 45 is formed of an outer housing 49 having a first opening 50, and of a container 51 for a single component toner, the container being rotatably mounted in the interior of the housing 49 and having a second opening 52. Container 51 is movable with respect to the housing 49 between a first end position and a second end position. In the second end position, the first opening 50 is aligned with the second opening 52.

The housing 49 and the container 51 consist of blow-molded parts, the housing being provided with longitudinal ribs 53 and 55 which are shaped as guides and which can be pushed into corresponding recesses 57 and 59 of station 9 or recesses 61 and 63 of station 15, the recesses being formed in the side wall 65 of the machine to secure the correct placement of such a cassette 45 in the cleaning station 15 and in the developing station 9. Only one side wall 65 of the machine is shown in the drawing. The longitudinal ribs 53, 55 at the blow-molded housing 49 are press-shaped.

To pivot the container 51 into either one of the two end positions, it is provided with a rotation knob 69 which is adapted to manual manipulation in that it is provided with knurls 67. The container 51 is further provided with a flange 71 which has a radial blocking arm 73 disposed on its periphery. During insertion or removal of the container, this blocking arm 73 can be pushed in or pulled out through either correspondingly designed recess 75 or 77 in the side wall 65 of the machine only if the cassette 45 is closed. If after insertion of cassette 45 into station 9 or 15 so that arm 73 moves through and past recess 75 or 77, the openings 50 and 52 of housing 49 and container 51, respectively, are brought into alignment, the blocking arm 73 will be angularly offset from recess 75 or 77 and will thus be blocked by side wall 65 in such a manner that the cassette cannot be withdrawn. This blocked position is shown at station 9 in FIG. 1. Only when in its closed state, shown in solid lines in FIG. 2 and at station 15 in FIG. 1, can the cassette 45 be pulled out of the developing station 9 or the cleaning station 15.

The housing 49 and the container 51 have a tubular shape and housing 49 engages in container 51 when inserted therein. For this purpose the cylindrical wall of container 51 is provided with a recess 79 which extends in the circumferential direction and which opens radially outwardly to engage, in the inserted state, a radially, inwardly directed detent tongue 81 disposed at the inner circumference of the housing 49 when the container 51 is pivoted between the two end positions relative to housing 49, the detent tongue 81 slides along in the recess 79 until it comes to rest against either one of the two side edges 83 and 85 of recess 79. The container 51 is made of one piece with the rotation knob 69 serving as the handle, with the flange 71 and with the recess 79.

The arrangement according to the invention is distinguished by its simple and inexpensive design and permits the use of a cassette containing a developer powder of a certain brand. This prevents reduction in quality of the resulting copies and unauthorized operation of the developing apparatus and possible damage to the machine.

The moving of the cassette 45 in the insertion direction is stopping when the ends 54 of the longitudinal ribs 53 and 55 arring the abutments 56 in the corresponding recesses 57 and 59.

It will be understood that the above description of the present invention is susceptible to various modifications, changes and adaptations, and the same are intended to be comprehended within the meaning and range of equivalents of the appended claims.

What is claimed is:

1. In a photocopier including a movable member carrying a photoconductive layer, a charging station for charging the layer, an illuminating station for photographically exposing the layer, a developing station provided with a magnetic brush and arranged to supply a magnetic single component toner to the brush for developing the image formed on the layer, a transfer station for transferring the developed image to a record material sheet, and a cleaning station for cleaning the layer, the stations being disposed in succession along the path of movement of the movable member for bringing each portion of the layer into operative association with each station in succession, in combination with a cassette containing a supply of such toner, the improvement wherein said developing station comprises means for receiving and holding said cassette in a position for dispensing toner for supply thereof to the magnetic brush, said cleaning station comprises means for receiving and holding said cassette in a position for collecting residual toner removed from the photoconductive layer in said cleaning station, whereby one and the same cassette can be used to initially supply toner to said developing station and, after having been emptied, can serve as a receptacle for residual toner in said cleaning station, said cassette has an open state in which a flow passage is present between its interior and the region outside of said cassette and a closed state in which its interior is closed, and said means at said developing and cleaning stations are constructed for permitting said cassette to be inserted in or removed from each said station only when in its closed state.

2. An arrangement as defined in claim 1 wherein: said cassette comprises an outer housing having a first opening, and a container for the toner; said container is disposed within said housing and has a second opening; said container is movable with respect to said housing between a first end position, in which said first and second openings are offset from one another, a second end position in which said first and said second openings are in alignment with one another; said housing and said container are made of blow-molded parts; said housing is provided with longitudinal ribs in the form of guides; and said means at each of said developing and cleaning stations present recesses formed in a side wall of said photocopier and configured to correspond to said ribs to secure said cassette in the correct position in either of said cleaning station and developing station.

3. An arrangement as defined in claim 2 wherein said longtitudinal ribs are press-molded onto said housing.

4. An arrangement as defined in claim 2 wherein said container comprises: handle means for pivoting said container between said two end positions, and a blocking arm; and said means at each of said developing and cleaning stations defines a recess shaped to correspond to said blocking arm and positioned for permitting said cassette to be inserted in or removed from each said station only when said container is in its first end position with respect to said housing.

5. An arrangement as defined in claim 2 wherein said housing and said container are each tubular in shape and said container is constructed to be inserted into said housing and arrested in said housing when inserted.

6. An arrangement as defined in claim 5 wherein said container is provided with a recess delimited by circumferentially spaced side edges, and said housing is provided with a detent tongue engaging in said recess of said container when said container is inserted in said housing, said detent tongue resting against a respective side edge when said container is in each of its end positions.

* * * * *